US012601519B2

(12) United States Patent
Ishigaki et al.

(10) Patent No.: US 12,601,519 B2
(45) Date of Patent: Apr. 14, 2026

(54) LEARNING DEVICE AND INFERENCE DEVICE FOR STATE OF AIR CONDITIONING SYSTEM

(71) Applicant: Mitsubishi Electric Corporation, Tokyo (JP)

(72) Inventors: Mitsuhiro Ishigaki, Tokyo (JP); Hiroaki Hokari, Tokyo (JP); Takahiro Hashikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 475 days.

(21) Appl. No.: 18/245,015

(22) PCT Filed: Dec. 11, 2020

(86) PCT No.: PCT/JP2020/046363
§ 371 (c)(1),
(2) Date: Mar. 13, 2023

(87) PCT Pub. No.: WO2022/123787
PCT Pub. Date: Jun. 16, 2022

(65) Prior Publication Data

US 2023/0358431 A1 Nov. 9, 2023

(51) Int. Cl.
*F24F 11/64* (2018.01)
*F24F 11/38* (2018.01)

(52) U.S. Cl.
CPC ..... *F24F 11/64* (2018.01); *F24F 11/38* (2018.01)

(58) Field of Classification Search
CPC ..... F24F 11/64; F24F 11/38; F24F 2110/12; F24F 11/32; F24F 11/49; F24F 2110/10;
(Continued)

(56) References Cited

U.S. PATENT DOCUMENTS

2013/0180272 A1* 7/2013 Ono ..... F25B 41/20 62/115
2015/0362238 A1* 12/2015 Tanaka ..... F25B 49/02 62/204

(Continued)

FOREIGN PATENT DOCUMENTS

EP 1956323 A2 8/2008
EP 2442043 A1 4/2012

(Continued)

OTHER PUBLICATIONS

International Search Report of the International Searching Authority mailed Jan. 12, 2021 for the corresponding International application No. PCT/JP2020/046363 (and English translation).

(Continued)

*Primary Examiner* — Alicia M. Choi
(74) *Attorney, Agent, or Firm* — Posz Law Group, PLC

(57) ABSTRACT

A learning device includes: a first data acquisition unit; and a model generation unit. The first data acquisition unit is configured to acquire operation data of an air conditioning system. The model generation unit is configured to convert a specific model into a trained model using the operation data. The operation data includes a specific parameter and at least one of a temperature of air passing through the second heat exchanger, a temperature and a pressure of refrigerant, and a temperature outside a space where each of at least one indoor unit is arranged. The specific model estimates the specific parameter from the operation data other than the specific parameter. The specific parameter includes at least one of an operating frequency of the compressor, a degree of opening of the expansion valve, and an amount of air blown per unit time by the blower.

18 Claims, 9 Drawing Sheets

(58) Field of Classification Search
CPC ..... F24F 2140/20; F24F 11/54; F24F 11/63; F24F 11/84; F24F 11/30; F25B 2313/0233; F25B 13/00; F25B 2700/1931; F25B 2700/1933; F25B 2700/21151; F25B 2700/21152; F25B 49/02; F25B 2600/21
See application file for complete search history.

(56) References Cited

U.S. PATENT DOCUMENTS

| | | | | |
|---|---|---|---|---|
| 2023/0053545 | A1* | 2/2023 | Fanidakis | G05B 19/41875 |
| 2023/0235933 | A1* | 7/2023 | Sasaki | F25B 49/02 62/129 |

FOREIGN PATENT DOCUMENTS

| | | | | |
|---|---|---|---|---|
| JP | H07-019567 | A | 1/1995 | |
| JP | 2006-343063 | A | 12/2006 | |
| JP | 2008-190847 | A | 8/2008 | |
| JP | 2011-017526 | A | 1/2011 | |
| JP | 2014-214970 | A | 11/2014 | |
| JP | 2017-221023 | A | 12/2017 | |
| JP | 2020153574 | A * | 9/2020 | F24F 11/63 |
| WO | WO-2015046066 | A1 * | 4/2015 | F25B 13/00 |

OTHER PUBLICATIONS

Extended European Search Report mailed Mar. 6, 2024 in corresponding European Patent Application No. 20965168.6.
Office Action mailed Dec. 5, 2023 in corresponding Japanese Patent Application No. 2022-568024 (and English translation).

* cited by examiner

FIG.3

| OPERATION DATA AT HH:MM ON YY/ZZ/XXXX | |
|---|---|
| SUCTION TEMPERATURE OF INDOOR UNITS | 27℃ |
| BLOWOUT TEMPERATURE OF INDOOR UNITS | 10℃ |
| DEGREE OF OPENING OF EXPANSION VALVES OF INDOOR UNITS | 200 PULSES |
| OPERATION STATE OF INDOOR UNITS | OPERATING |
| OPERATION MODE OF INDOOR UNITS | COOLING |
| SET TEMPERATURE OF INDOOR UNITS | 25℃ |
| ROTATION SPEED OF FANS OF INDOOR UNITS | 300rpm |
| OUTDOOR AIR TEMPERATURE | 35℃ |
| CURRENT VALUE OF INVERTER OF COMPRESSOR | 25A |
| VOLTAGE VALUE OF INVERTER OF COMPRESSOR | 280V |
| HEAT SINK TEMPERATURE | 70℃ |
| HIGH PRESSURE | 3.5Mpa |
| LOW PRESSURE | 1.7Mpa |
| DISCHARGE TEMPERATURE | 100℃ |
| LIQUID PIPE TEMPERATURE | 10℃ |
| OPERATING FREQUENCY OF COMPRESSOR | 75Hz |
| ROTATION SPEED OF FAN OF OUTDOOR UNIT | 400rpm |
| EVAPORATION TEMPERATURE | 0℃ |
| CONDENSATION TEMPERATURE | 45℃ |
| ⋮ | |

LEARNING DEVICE AND INFERENCE DEVICE FOR STATE OF AIR CONDITIONING SYSTEM

CROSS REFERENCE TO RELATED APPLICATION

This application is a U.S. national stage application of PCT/JP2020/046363 filed on Dec. 11, 2020, the contents of which are incorporated herein by reference.

TECHNICAL FIELD

The present disclosure relates to a learning device and an inference device for a state of an air conditioning system.

BACKGROUND ART

Conventionally, there has been known a device that detects an abnormality of an air conditioning system. For example, Japanese Patent Laying-Open No. 2017-221023 (PTL 1) discloses a failure sign detection device that accurately estimates an internal state of a compressor by analyzing a q-axis current that is less affected by electrical noise. According to the failure sign detection device, the accuracy of detection of an abnormality of the compressor can be improved.

CITATION LIST

Patent Literature

PTL 1: Japanese Patent Laying-Open No. 2017-221023

SUMMARY OF INVENTION

Technical Problem

PTL 1 discloses that the abnormality of the compressor is detected when an intensity of an operating frequency component of the compressor exceeds a threshold value as a result of fast Fourier transform (FFT) analysis. However, the threshold value may vary depending on the operating environment of an air conditioning system. Therefore, when a common threshold value is used regardless of the operating environment of the air conditioning system, the accuracy of estimation of a state of the air conditioning system may decrease.

The present disclosure has been made to solve the above-described problem, and an object thereof is to improve the accuracy of estimation of a state of an air conditioning system.

Solution to Problem

A learning device according to one aspect of the present disclosure learns a state of an air conditioning system in which refrigerant circulates. The air conditioning system includes an outdoor unit and at least one indoor unit. The outdoor unit includes a compressor, a first heat exchanger, and a blower configured to blow air to the first heat exchanger. The at least one indoor unit includes an expansion valve and a second heat exchanger. The refrigerant circulates in order of the compressor, the first heat exchanger, the expansion valve, and the second heat exchanger, or circulates in order of the compressor, the second heat exchanger, the expansion valve, and the first heat exchanger. The learning device includes a first data acquisition unit; and a model generation unit. The first data acquisition unit is configured to acquire operation data of the air conditioning system. The model generation unit is configured to convert a specific model into a trained model by using the operation data. The operation data includes a specific parameter and at least one of a temperature of air passing through the second heat exchanger, a temperature and a pressure of the refrigerant, and a temperature outside a space where each of the at least one indoor unit is arranged. The specific model estimates the specific parameter from the operation data other than the specific parameter. The specific parameter includes at least one of an operating frequency of the compressor, a degree of opening of the expansion valve, and an amount of air blown per unit time by the blower.

An inference device according to another aspect of the present disclosure infers a state of an air conditioning system in which refrigerant circulates, by using a trained specific model. The air conditioning system includes an outdoor unit and at least one indoor unit. The outdoor unit includes a compressor, a first heat exchanger, and a blower configured to blow air to the first heat exchanger. The at least one indoor unit includes an expansion valve and a second heat exchanger. The refrigerant circulates in order of the compressor, the first heat exchanger, the expansion valve, and the second heat exchanger, or circulates in order of the compressor, the second heat exchanger, the expansion valve, and the first heat exchanger. The inference device includes: a data acquisition unit; and an inference unit. The data acquisition unit is configured to acquire operation data of the air conditioning system. The inference unit is configured to estimate a specific parameter from the operation data by using the specific model. The operation data includes at least one of a temperature of air subjected to heat exchange with the second heat exchanger, a temperature and a pressure of the refrigerant, and a temperature outside a space where each of the at least one indoor unit is arranged. The specific parameter includes at least one of an operating frequency of the compressor, a degree of opening of the expansion valve, and an amount of air blown per unit time by the blower.

Advantageous Effects of Invention

In the learning device and the inference device according to the present disclosure, the operation data includes at least one of the temperature of air subjected to heat exchange with the second heat exchanger, the temperature and the pressure of the refrigerant, and the temperature outside the space where the at least one indoor unit is arranged, and thus, the accuracy of estimation of the state of the air conditioning system can be improved.

BRIEF DESCRIPTION OF DRAWINGS

FIG. 3 shows an example of operation data that reflects a state of the air conditioning system.

DESCRIPTION OF EMBODIMENTS

Figure 1:
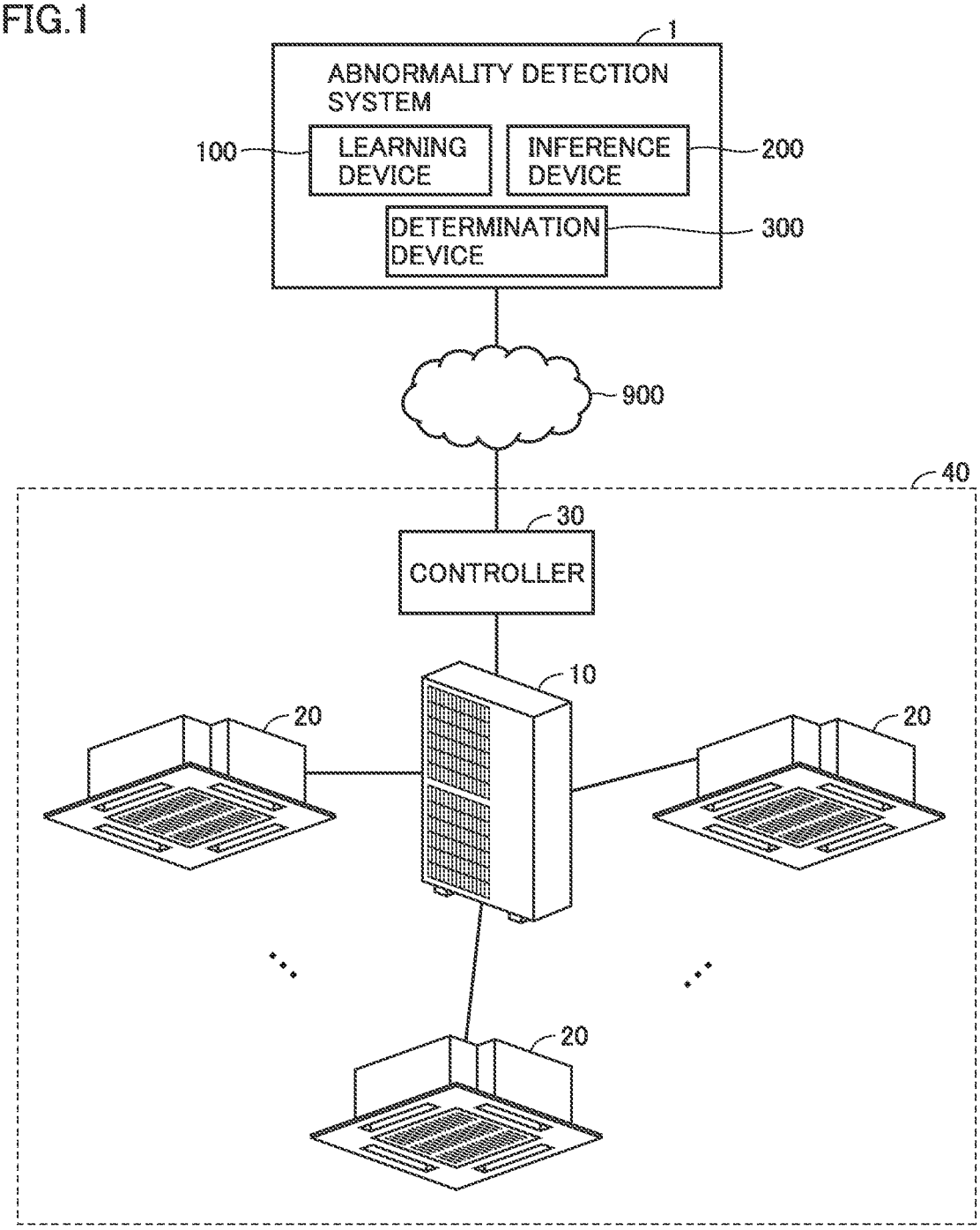
FIG. 1 is a block diagram showing an example of configurations of an abnormality detection system including a learning device and an inference device according to an embodiment, and an air conditioning system whose state is monitored by the abnormality detection system.

An embodiment of the present disclosure will be described in detail hereinafter with reference to the drawings, in which the same or corresponding portions are denoted by the same reference characters and description thereof will not be repeated in principle.

FIG. 1 is a block diagram showing an example of configurations of an abnormality detection system 1 including a learning device 100 and an inference device 200 according to an embodiment, and an air conditioning system 40 whose state is monitored by an abnormality detection system 1. As shown in FIG. 1, abnormality detection system 1 is connected to air conditioning system 40 via a network 900.

Abnormality detection system 1 includes learning device 100, inference device 200 and a determination device 300. Air conditioning system 40 includes a plurality of indoor units 20, an outdoor unit 10 and a controller 30. Each of the plurality of indoor units 20 is arranged in an indoor space and is connected to outdoor unit 10. Outdoor unit 10 is arranged in a space (outdoor space) outside the indoor space. The number of indoor units 20 included in air conditioning system 40 may be one.

Outdoor unit 10 includes a compressor, an outdoor heat exchanger (first heat exchanger) and an outdoor fan (blower). Each of the plurality of indoor units 20 includes an expansion valve and an indoor heat exchanger (second heat exchanger). Refrigerant is supplied from the compressor included in outdoor unit 10 to each of the plurality of indoor units 20. The refrigerant circulates between each of the plurality of indoor units 20 and outdoor unit 10.

Controller 30 includes a thermostat and controls air conditioning system 40 in an integrated manner. Controller 30 is connected to abnormality detection system 1 via network 900. Network 900 includes the Internet and a cloud system.

Figure 2:
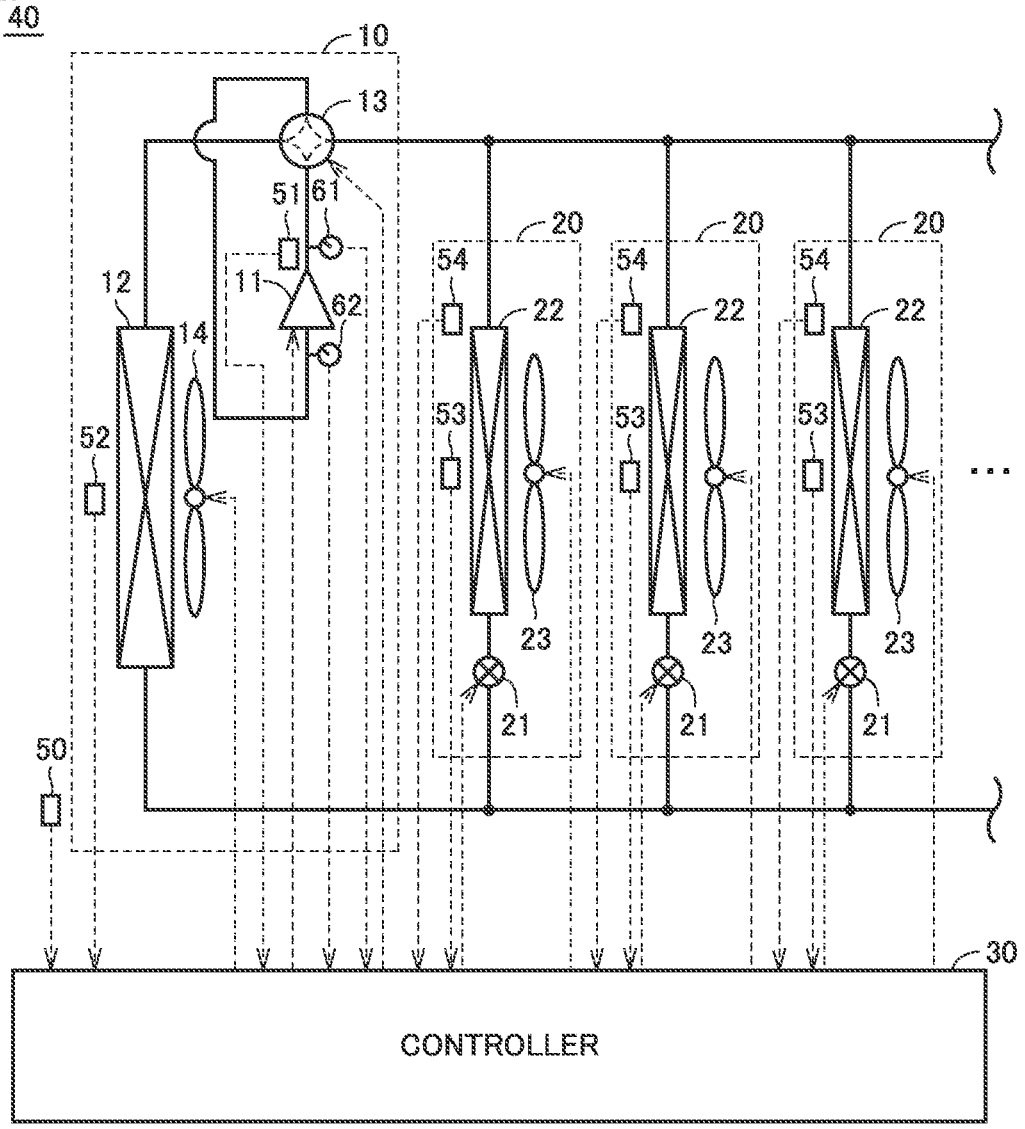
FIG. 2 is a functional block diagram showing a configuration of the air conditioning system in FIG. 1.

FIG. 2 is a functional block diagram showing a configuration of air conditioning system 40 in FIG. 1. As shown in FIG. 2, outdoor unit 10 includes a compressor 11, an outdoor heat exchanger 12 (first heat exchanger), a four-way valve 13, an outdoor fan 14 (blower), temperature sensors 51 and 52, and pressure sensors 61 and 62. Each of the plurality of indoor units 20 includes an expansion valve 21, an indoor heat exchanger 22 (second heat exchanger), an indoor fan 23, and temperature sensors 53 and 54. A temperature sensor 50 is arranged in the outdoor space. Expansion valve 21 includes, for example, a linear expansion valve (LEV). Each of temperature sensors 50 to 54 includes a thermistor.

Operation modes of air conditioning system 40 includes a heating mode, a cooling mode and a defrosting mode. In the heating mode, four-way valve 13 connects a discharge port of compressor 11 to indoor heat exchangers 22 and connects outdoor heat exchanger 12 to a suction port of compressor 11. In the heating mode, the refrigerant circulates in the order of compressor 11, four-way valve 13, indoor heat exchangers 22, expansion valves 21, and outdoor heat exchanger 12. In the cooling mode and the defrosting mode, four-way valve 13 connects the discharge port of compressor 11 to outdoor heat exchanger 12 and connects indoor heat exchangers 22 to the suction port of compressor 11. In the cooling mode and the defrosting mode, the refrigerant circulates in the order of compressor 11, four-way valve 13, outdoor heat exchanger 12, expansion valves 21, and indoor heat exchangers 22.

Temperature sensor 50 measures a temperature (outdoor air temperature) of the outdoor space, and outputs the outdoor air temperature to controller 30. Temperature sensor 51 measures a temperature (discharge temperature) of the refrigerant discharged from compressor 11, and outputs the discharge temperature to controller 30. Temperature sensor 52 measures a temperature (evaporation temperature or condensation temperature) of the refrigerant passing through outdoor heat exchanger 12, and outputs the temperature to controller 30. Temperature sensor 53 measures a temperature (condensation temperature or evaporation temperature) of the refrigerant passing through indoor heat exchanger 22, and outputs the temperature to controller 30. Temperature sensor 54 measures a temperature (suction temperature or blowout temperature) of air passing through indoor heat exchanger 22, and outputs the temperature to controller 30. Pressure sensor 61 measures a pressure (high pressure) of the refrigerant discharged from compressor 11, and outputs the high pressure to controller 30. Pressure sensor 62 measures a pressure (low pressure) of the refrigerant suctioned to compressor 11, and outputs the low pressure to controller 30.

Controller 30 controls an operating frequency of compressor 11 to control an amount of the refrigerant discharged per unit time by compressor 11. Controller 30 controls a degree of opening of expansion valves 21. Controller 30 controls four-way valve 13 to switch a circulation direction of the refrigerant. Controller 30 controls a rotation speed of each of outdoor fan 14 and indoor fans 23 to control an amount of air blown per unit time by the fan. Controller 30 associates operation data that reflects the state of the air conditioning system with the measurement time, and transmits the operation data to the abnormality detection system.

FIG. 3 shows an example of the operation data that reflects the state of air conditioning system 40. As shown in FIG. 3, the operation data includes, for example, the outdoor air temperature, the discharge temperature, the evaporation temperature, the condensation temperature, the suction temperature, the blowout temperature, the high pressure, the low pressure, the operating frequency of compressor 11, the degree of opening of expansion valves 21, the operation mode, an operation state (operating, stop or standby), the rotation speed of each of outdoor fan 14 and indoor fans 23, a temperature (set temperature) of the indoor space set by a user, a current value of an inverter of compressor 11, a voltage value of the inverter, a temperature of a heat sink included in outdoor unit 10, and a temperature (liquid pipe temperature) of a liquid pipe (pipe through which liquid refrigerant flows) that connects outdoor unit 10 and indoor units 20.

The operating environment of air conditioning system 40 may have characteristics (e.g., a length of a refrigerant pipe, a type of indoor units 20, the number of indoor units 20, and a height difference between indoor units 20 and outdoor unit 10) specific to the environment. Therefore, a determination criterion (e.g., threshold value) for detecting an abnormality of air conditioning system 40 may vary depending on the operating environment of air conditioning system 40. Thus, when a common determination criterion is used regardless of the operating environment of air conditioning system 40, the accuracy of estimation of the state of air conditioning system 40 may decrease.

Accordingly, in abnormality detection system 1, a relationship between the operation data of air conditioning system 40 and a specific parameter of air conditioning system 40 is learned to generate a trained model. By using the trained model, an abnormality of air conditioning system 40 can be detected based on the determination criterion that matches the operating environment of air conditioning system 40. As a result, the accuracy of estimation of the state of the air conditioning system can be improved.

Figure 4:
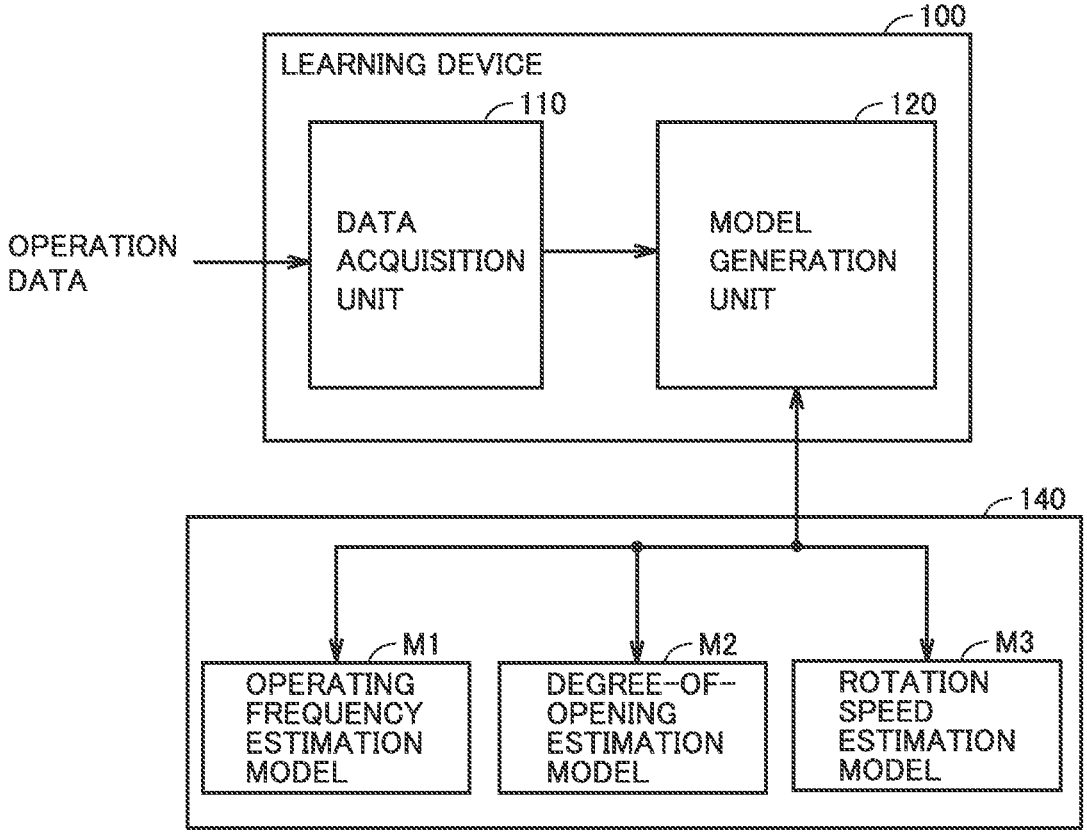
FIG. 4 is a block diagram showing a configuration of the learning device in FIG. 1.

FIG. 4 is a block diagram showing a configuration of learning device 100 in FIG. 1. As shown in FIG. 4, learning device 100 includes a data acquisition unit 110 (first data acquisition unit) and a model generation unit 120. An operating frequency estimation model M1 (specific model), a degree-of-opening estimation model M2 (specific model) and a rotation speed estimation model M3 (specific model) are stored in a trained model storage unit 140 provided outside learning device 100. Trained model storage unit 140 may be formed inside learning device 100. Alternatively, at least one of operating frequency estimation model M1, degree-of-opening estimation model M2 and rotation speed estimation model M3 may be stored in trained model storage unit 140.

Operating frequency estimation model M1 is a regression model that receives the parameters other than the operating frequency of compressor 11, of the parameters included in the operation data of air conditioning system 40, and outputs the operating frequency of compressor 11 (specific parameter). Degree-of-opening estimation model M2 is a regression model that receives the parameters other than the degree of opening of expansion valves 21, of the parameters included in the operation data of air conditioning system 40, and outputs the degree of opening of expansion valves 21 (specific parameter). Rotation speed estimation model M3 is a regression model that receives the parameters other than the rotation speed of outdoor fan 14, of the parameters included in the operation data of air conditioning system 40, and outputs the rotation speed of outdoor fan 14 (specific parameter). Each of operating frequency estimation model M1, degree-of-opening estimation model M2 and rotation speed estimation model M3 includes, for example, a neural network. The operating frequency of compressor 11, the degree of opening of expansion valves 21, and the rotation speed of outdoor fan 14 are basic amounts of operation in variable refrigerant flow (VRF) control.

Data acquisition unit 110 acquires a plurality of pieces of operation data from air conditioning system 40. Model generation unit 120 learns a relationship between the operation data and each of the operating frequency of compressor 11, the degree of opening of expansion valves 21, and the rotation speed of outdoor fan 14, by using training data created using each of the plurality of pieces of operation data. Model generation unit 120 converts each of operating frequency estimation model M1, degree-of-opening estimation model M2 and rotation speed estimation model M3 into a trained model by using the training data. A period and an interval of acquisition of the operation data are arbitrary. A general artificial intelligence (AI) technique can be applied to clustering and weighting of the parameters included in the operation data.

The learning algorithm used by model generation unit 120 may be a known algorithm such as supervised learning, unsupervised learning, or reinforcement learning. The case where a neural network is applied will be described below.

Model generation unit 120 learns a relationship between the operation data and each of the operating frequency of compressor 11, the degree of opening of expansion valves 21, and the rotation speed of outdoor fan 14 by supervised learning in accordance with, for example, a neural network model. Here, the supervised learning refers to a method of learning features included in training data by giving the training data, which is a set of input data (operation data) and ground truth data (label) to learning device 100 and inferring a result from the input. The operating frequency of compressor 11, the degree of opening of expansion valves 21, and the rotation speed of outdoor fan 14 when air conditioning system 40 is in a normal state (e.g., during an accidental failure period) can be used as the ground truth data.

The neural network of the regression model includes an input layer including a plurality of neurons, an intermediate layer (hidden layer) including a plurality of neurons, and an output layer including one neuron. The intermediate layer may include one layer or two or more layers.

Figure 5:
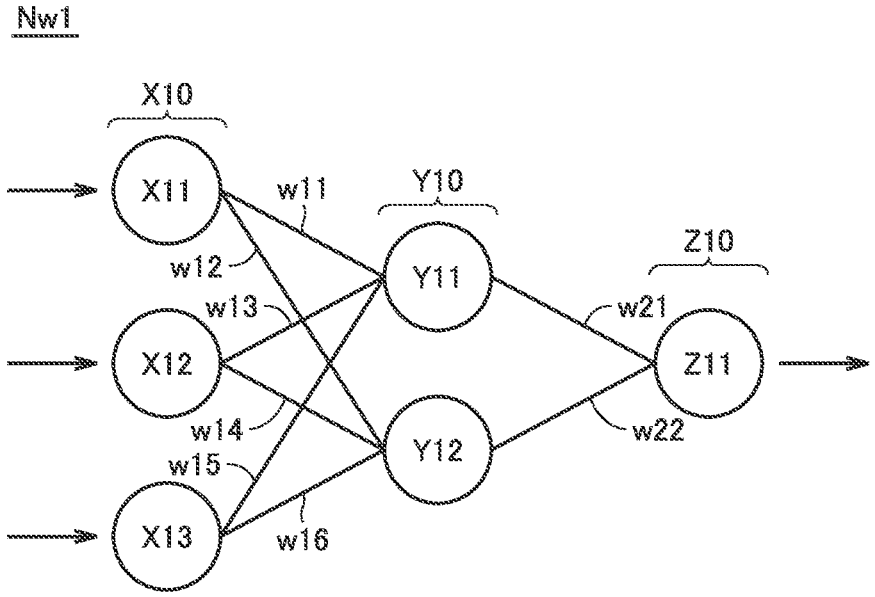
FIG. 5 shows an example of a neural network.

FIG. 5 shows an example of the neural network. As shown in FIG. 5, a neural network Nw1 includes an input layer X10, an intermediate layer Y10, and an output layer Z10. Input layer X10 includes neurons X11, X12 and X13. Intermediate layer Y10 includes neurons Y11 and Y12. Output layer Z10 includes a neuron Z11. Input layer X10 and intermediate layer Y10 are fully connected to each other. Intermediate layer Y10 and output layer Z10 are fully connected to each other.

When a plurality of inputs are input to neurons X11 to X13 of input layer X10, the values thereof are multiplied by weights w11 to w16, and are input to neurons Y11 and Y12 of intermediate layer Y10. Outputs from neurons Y11 and Y12 are multiplied by weights w21 and w22, and are output from neuron Z11 of output layer Z10. The output result from output layer Z10 varies depending on the values of weights w11 to w16 and w21 and w22.

The neural network of each of operating frequency estimation model M1, degree-of-opening estimation model M2 and rotation speed estimation model M3 learns a relationship between the operation data and the specific parameter corresponding to the model by supervised learning in accordance with the training data created using the operation data acquired by data acquisition unit 110. That is, the weight and bias of the neural network of the model are updated by back propagation with respect to the error between the result output from the output layer in response to an input of the operation data to the input layer and the ground truth data such that the result approaches the specific parameter of the ground truth data.

Figure 6:
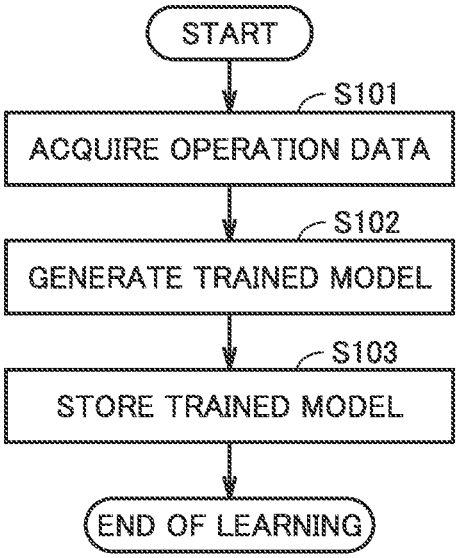
FIG. 6 is a flowchart showing a learning process performed by the learning device in FIG. 4.

FIG. 6 is a flowchart showing a learning process performed by learning device 100 in FIG. 4. In the following description, the step will be simply denoted as "S". As shown in FIG. 6, in S101, data acquisition unit 110 acquires the operation data.

In S102, model generation unit 120 learns a relationship between the operation data and each of the operating frequency of compressor 11, the degree of opening of expansion valves 21, and the rotation speed of outdoor fan 14 by supervised learning in accordance with the training data acquired by data acquisition unit 110, and converts each of operating frequency estimation model M1, degree-of-opening estimation model M2 and rotation speed estimation model M3 into a trained model.

In S103, model generation unit 120 stores trained operating frequency estimation model M1, trained degree-of-opening estimation model M2 and trained rotation speed estimation model M3 in trained model storage unit 140, and ends the learning process.

Figure 7:
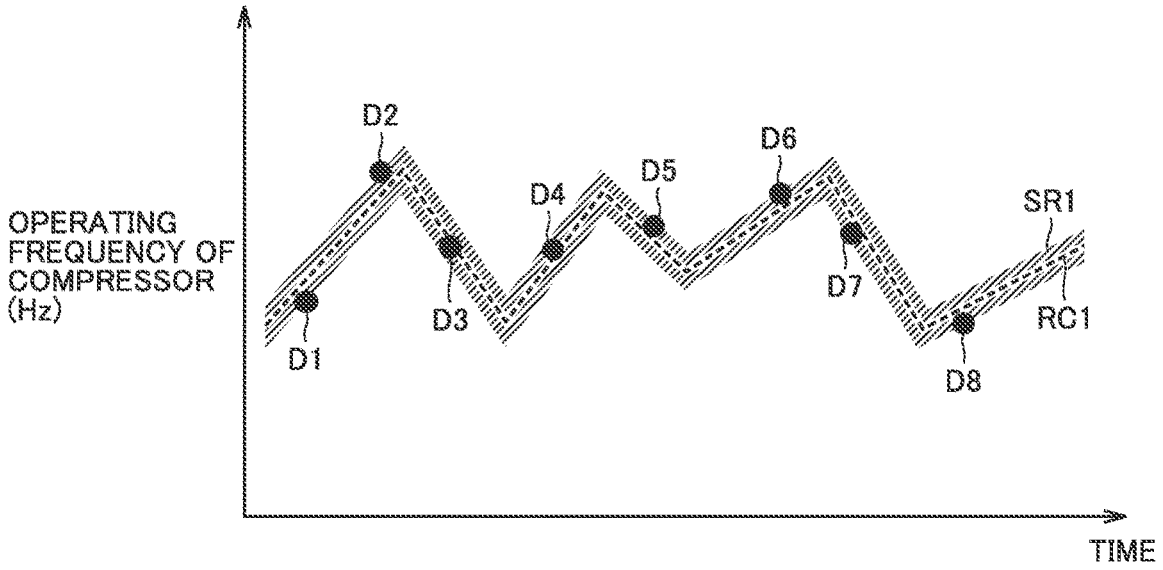
FIG. 7 shows ground truth data of a specific parameter and a time chart of the specific parameter estimated by a trained model.

FIG. 7 shows ground truth data D1, D2, D3, D4, D5, D6, D7, and D8 of a specific parameter and a time chart RC1 of the specific parameter estimated by a trained model. In FIG. 7, the case where the specific parameter is the operating frequency of compressor 11 will be described. Each of dots D1 to D8 represents the operating frequency of compressor 11 when air conditioning system 40 is in a normal state. Time chart RC1 is time-series data of the operating frequency of compressor 11 estimated by trained operating frequency estimation model M1. A region SR1 represents a region where the operating frequency of compressor 11 is normal. Normal region SR1 is set as a region where a deviation rate from time chart RC1 (estimated value of the trained model) is within a reference value (e.g., 5%). For example, when the deviation rate is equal to or lower than 5% and the operating frequency of compressor 11 estimated by trained operating frequency estimation model M1 is 100 Hz at a certain time, normal region SR1 of compressor 11 at this time is within the range of 95 Hz to 105 Hz. When the operating frequency of compressor 11 at this time is included within the range of 95 Hz to 105 Hz, it is determined that air conditioning system 40 is in a normal state. When the operating frequency of compressor 11 at this time is not included within the range of 95 Hz to 105 Hz, it is determined that air conditioning system 40 is in an abnormal state. The same applies as well to the degree of opening of expansion valves 21 and the rotation speed of outdoor fan 14. The deviation rate from the estimated value of the trained model can be set by the user and can be determined as appropriate by experiments on an actual machine, or simulation.

When the actual operating frequency of compressor 11 is higher than the normal region of the estimated operating frequency of compressor 11, defects such as a shortage of the refrigerant, poor heat transfer in outdoor unit 10, and failure to close expansion valves 21 are estimated as causes of the abnormality. When the actual operating frequency of compressor 11 is lower than normal region SR1, defects such as a shortage of the refrigerant, poor heat transfer in indoor units 20, and failure to open expansion valves 21 are estimated as causes of the abnormality.

When the actual degree of opening of expansion valves 21 is larger than the normal region of the estimated degree of opening of expansion valves 21, a shortage of the refrigerant (during cooling) is estimated as a cause of the abnormality. When the actual degree of opening of expansion valves 21 is smaller than the normal region, a shortage of the refrigerant (during heating), poor heat transfer in outdoor unit 10, and poor heat transfer in indoor units 20 are estimated as causes of the abnormality.

When the actual rotation speed of outdoor fan 14 is higher than the normal region of the estimated rotation speed of outdoor fan 14, defects such as a shortage of the refrigerant (during heating), poor heat transfer in outdoor unit 10, and failure to open expansion valves 21 are estimated as causes of the abnormality. When the actual rotation speed of outdoor fan 14 is lower than the normal region, defects such as a shortage of the refrigerant (during cooling) and failure to close expansion valves 21 are estimated as causes of the abnormality.

Figure 8:
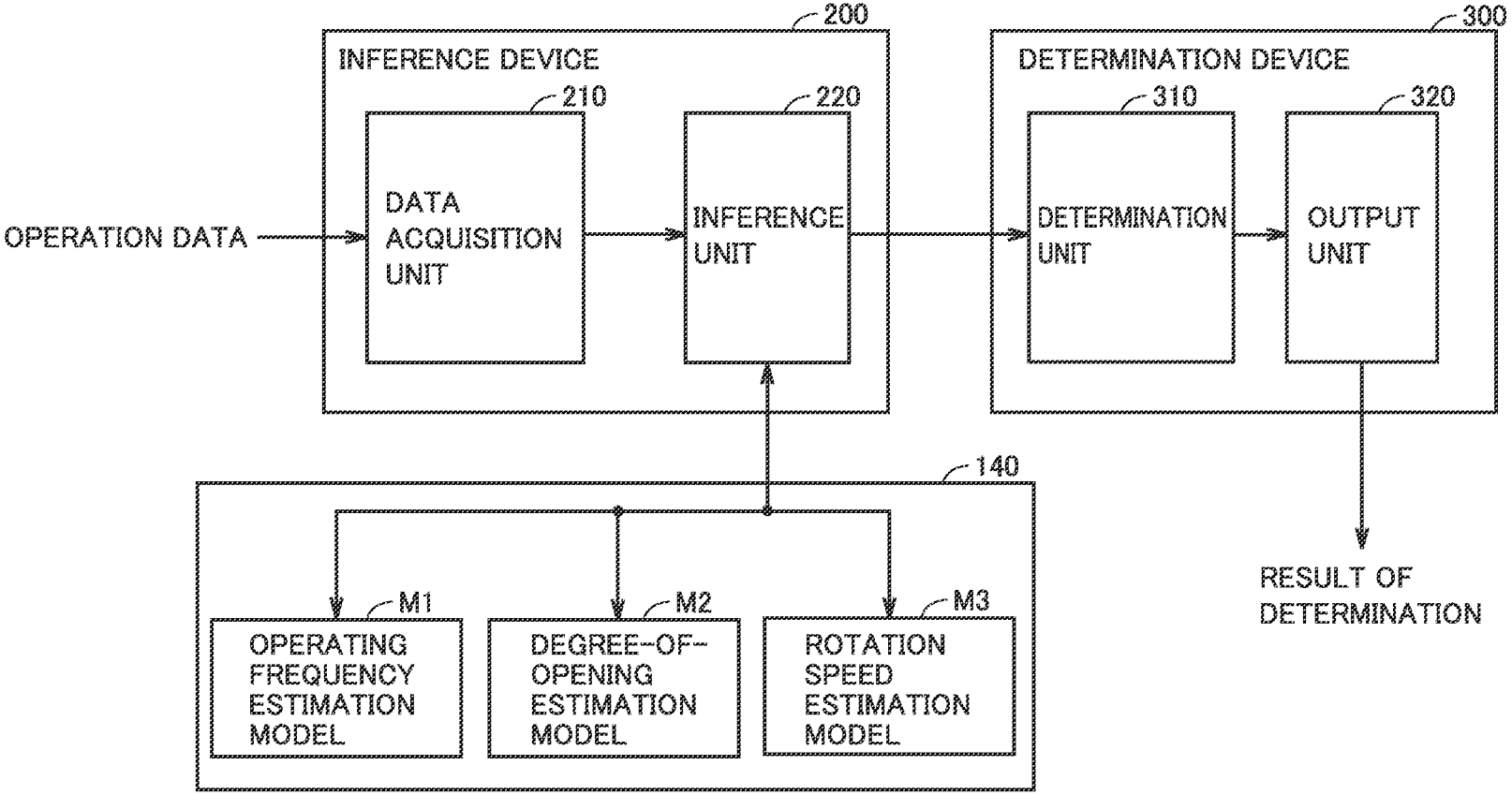
FIG. 8 is a block diagram showing configurations of the inference device and a determination device in FIG. 1.

FIG. 8 is a block diagram showing configurations of inference device 200 and determination device 300 in FIG. 1. Inference device 200 includes a data acquisition unit 210 (second data acquisition unit) and an inference unit 220. Determination device 300 includes a determination unit 310 and an output unit 320.

Data acquisition unit 210 acquires the operation data from air conditioning system 40. Inference unit 220 estimates the operating frequency of compressor 11, the degree of opening of expansion valves 21, and the rotation speed of outdoor fan 14 by using trained models M1 to M3 stored in trained model storage unit 140, respectively. Although the operating frequency of compressor 11, the degree of opening of expansion valves 21, and the rotation speed of outdoor fan 14 are estimated by using the trained models learned in model generation unit 120 in FIG. 4 in the embodiment, the operating frequency of compressor 11, the degree of opening of expansion valves 21, and the rotation speed of outdoor fan 14 may be estimated by using trained models learned in other environment.

Figure 9:
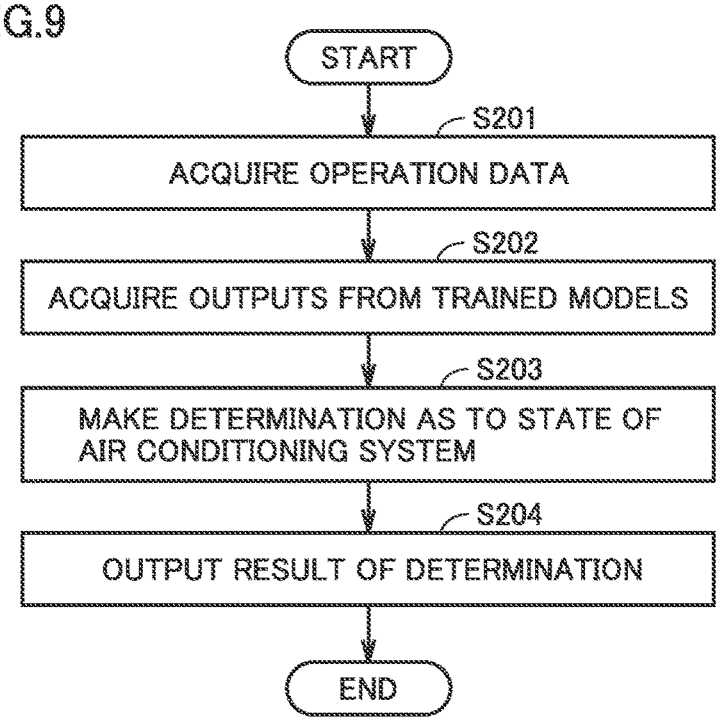
FIG. 9 is a flowchart showing an inference process performed by the inference device in FIG. 8 and a determination process performed by the determination device in FIG. 8.

FIG. 9 is a flowchart showing an inference process performed by inference device 200 in FIG. 8 and a determination process performed by determination device 300 in FIG. 8. As shown in FIG. 9, in S201, data acquisition unit 210 acquires the operation data of air conditioning system 40. In S202, inference unit 220 inputs the operation data to trained models M1 to M3 stored in trained model storage unit 140, and acquires the operating frequency of compressor 11, the degree of opening of expansion valves 21, and the rotation speed of outdoor fan 14, respectively. In S203, determination unit 310 makes a determination as to whether air conditioning system 40 is in a normal state or in an abnormal state, by using the operating frequency of compressor 11 output from trained operating frequency estimation model M1, the degree of opening of expansion valves 21 output from trained degree-of-opening estimation model M2, and the rotation speed of outdoor fan 14 output from trained rotation speed estimation model M3. For example, when any one of the operating frequency of compressor 11, the degree of opening of expansion valves 21, and the rotation speed of outdoor fan 14 is not included within the normal range, determination unit 310 determines that air conditioning system 40 is in an abnormal state. In S204, output unit 320 transmits a result of the determination made by determination unit 310 in S203 to an external device (e.g., a terminal device of the user or controller 30). When the result of the determination is abnormal, output unit 320 may transmit the estimated causes of the abnormality to the external device, together with the result of the determination.

Figure 10:
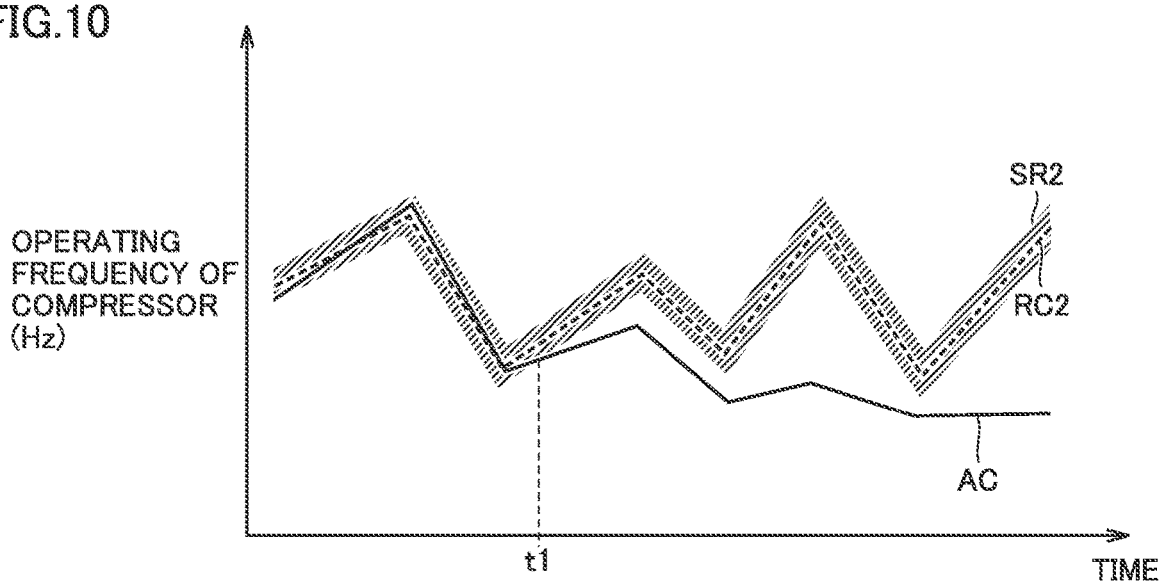
FIG. 10 shows a time chart of a specific parameter estimated by a trained model, a normal region of the parameter, and a time chart of an actual specific parameter.

FIG. 10 shows a time chart RC2 of a specific parameter estimated by a trained model, a normal region SR2 of the parameter, and a time chart AC of an actual specific parameter. In FIG. 10, the case where the specific parameter is the operating frequency of compressor 11 will be described. As shown in FIG. 10, after time t1, the actual operating frequency of compressor 11 is not included within normal region SR2. The occurrence of an abnormality of air conditioning system 40 is transmitted from abnormality detection system 1 to the external device after time t1.

Figure 11:
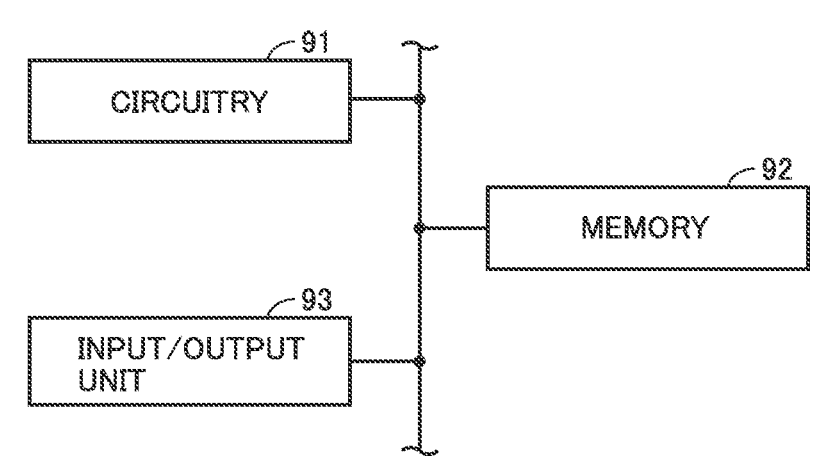
FIG. 11 is a block diagram showing a hardware configuration of the abnormality detection system in FIG. 1.

FIG. 11 is a block diagram showing a hardware configuration of abnormality detection system 1 in FIG. 1. As shown in FIG. 11, abnormality detection system 1 includes a circuitry 91, a memory 92 (storage unit) and an input/output unit 93. Circuitry 91 includes a central processing unit (CPU) that executes a program stored in memory 92. Circuitry 91 may include a graphics processing unit (GPU). The function of abnormality detection system 1 is implemented by software, firmware, or a combination of the software and the firmware. The software or the firmware is described as a program and stored in memory 92. Circuitry 91 reads and executes the program stored in memory 92. The CPU is also called a central processing unit, a processing unit, an operation unit, a microprocessor, a microcomputer, a processor, or a digital signal processor (DSP).

Memory 92 includes a non-volatile or volatile semiconductor memory (e.g., a random access memory (RAM), a read only memory (ROM), a flash memory, an erasable programmable read only memory (EPROM), or an electrically erasable programmable read only memory (EEPROM)), and a magnetic disk, a flexible disk, an optical disk, a compact disk, a minidisc, or a digital versatile disc (DVD). The trained models, an abnormality detection program and a machine learning program are, for example, stored in memory 92.

Input/output unit 93 receives an operation from the user and outputs a result of processing to the user. Input/output unit 93 includes, for example, a mouse, a keyboard, a touch panel, a display, and a speaker.

Although the case where the supervised learning is applied to the learning algorithm used by model generation unit 120 is described in the embodiment, the learning algorithm is not limited to the supervised learning. In addition to the supervised learning, reinforcement learning, unsupervised learning, semi-supervised learning or the like can also be applied to the learning algorithm.

In addition, deep learning that learns extraction of a feature quantity itself can also be used as the learning algorithm used by model generation unit 120. Machine learning may be performed in accordance with other known methods such as, for example, a neural network, genetic programming, functional logic programming, or a support vector machine.

Although learning device 100 and inference device 200 are described as devices that are connected to air conditioning system 40 via network 900 and are separate from air conditioning system 40 in the embodiment, learning device 100 and inference device 200 may be built into air conditioning system 40. Alternatively, learning device 100 and inference device 200 may be present on a cloud server.

As described above, in the learning device and the inference device according to the embodiment, the accuracy of estimation of the state of the air conditioning system can be improved.

It should be understood that the embodiment disclosed herein is illustrative and non-restrictive in every respect. The scope of the present disclosure is defined by the terms of the claims, rather than the description above, and is intended to include any modifications within the scope and meaning equivalent to the terms of the claims.

REFERENCE SIGNS LIST

1 abnormality detection system; 10 outdoor unit; 11 compressor; 12 outdoor heat exchanger; 13 four-way valve; 14 outdoor fan; 20 indoor unit; 21 expansion valve; 22 indoor heat exchanger; 23 indoor fan; 30 controller; 40 air conditioning system; 50 to 54 temperature sensor; 61, 62 pressure sensor; 91 circuitry; 92 memory; 93 input/output unit; 100 learning device; 110, 210 data acquisition unit; 120 model generation unit; 140 trained model storage unit; 200 inference device; 220 inference unit; 300 determination device; 310 determination unit; 320 output unit; 900 network; M1 operating frequency estimation model; M2 degree-of-opening estimation model; M3 rotation speed estimation model; Nw1 neural network.

The invention claimed is:

1. A learning device that learns a state of an air conditioning system in which refrigerant circulates, wherein the air conditioning system includes an outdoor unit and at least one indoor unit, the outdoor unit includes a compressor, a first heat exchanger, and a blower configured to blow air to the first heat exchanger, the at least one indoor unit includes an expansion valve and a second heat exchanger, the refrigerant circulates in order of the compressor, the first heat exchanger, the expansion valve, and the second heat exchanger, or circulates in order of the compressor, the second heat exchanger, the expansion valve, and the first heat exchanger, the learning device comprises circuitry configured to:

acquire operation data of the air conditioning system; and convert a specific model into a trained model by using the operation data, wherein the operation data includes a specific parameter and at least one of a temperature of air passing through the second heat exchanger, a temperature and a pressure of the refrigerant, a temperature outside a space where each of the at least one indoor unit is arranged, and at least one of a current value and a voltage value of an inverter of the compressor, a temperature of a heat sink included in the outdoor unit, and a temperature of a liquid pipe that connects the outdoor unit and each of the at least one indoor unit, the specific model estimates the specific parameter from the operation data other than the specific parameter, and the specific parameter includes at least one of a degree of opening of the expansion valve and an amount of air blown per unit time by the blower.

2. The learning device according to claim 1, wherein the circuitry is configured to perform supervised learning on the specific model by using, as ground truth data, the operation data when the air conditioning system is in a normal state.

3. An inference device comprising:

circuitry configured to:

acquire the operation data; and use the trained model generated by the learning device according to claim 1, wherein the circuitry is further configured to estimate the specific parameter from the operation data which is acquired, by using the trained model.

4. The learning device according to claim 1, wherein the specific model have been trained by machine learning, wherein the machine learning includes supervised learning.

5. The learning device according to claim 1, wherein the specific model includes a neural network.

6. The learning device according to claim 1, wherein the circuitry is further configured to acquire, as time passes, the operation data from the air conditioning system, which is used to convert the specific model into the trained model, wherein the at least one of the temperature of air passing through the second heat exchanger, the temperature and the pressure of the refrigerant, and the temperature outside the space where each of the at least one indoor unit is arranged, are associated with each other.

7. The learning device according to claim 1, further comprising a memory configured to store the specific model.

8. The learning device according to claim 1, wherein the circuitry is further configured to cluster and weight parameters in the operation data.

9. The learning device according to claim 1, wherein the circuitry is further configured to update a weight and bias of the specific model using back propagation with respect to an error between an output result of the specific model and ground truth data.

10. An inference device that infers a state of an air conditioning system in which refrigerant circulates, by using a specific model which is trained, wherein the air conditioning system includes an outdoor unit and at least one indoor unit, the outdoor unit includes a compressor, a first heat exchanger, and a blower configured to blow air to the first heat exchanger, the at least one indoor unit includes an expansion valve and a second heat exchanger, the refrigerant circulates in order of the compressor, the first heat exchanger, the expansion valve, and the second heat exchanger, or circulates in order of the compressor, the second heat exchanger, the expansion valve, and the first heat exchanger, the inference device comprises circuitry configured to:

acquire operation data of the air conditioning system; and estimate a specific parameter from the operation data by using the specific model, wherein the operation data includes at least one of a temperature of air subjected to heat exchange with the second heat exchanger, a temperature and a pressure of the refrigerant, a temperature outside a space where each of the at least one indoor unit is arranged, and at least one of a current value and a voltage value of an inverter of the compressor, a temperature of a heat sink included in the outdoor unit, and a temperature of a liquid pipe that connects the outdoor unit and each of the at least one indoor unit, and the specific parameter includes at least one of a degree of opening of the expansion valve and an amount of air blown per unit time by the blower.

11. The inference device according to claim 10, wherein the specific model is generated by supervised learning.

12. The inference device according to claim 10, wherein the circuitry is further configured to make a determination as to whether the air conditioning system is normal or abnormal, by using the specific parameter which is estimated and actual operation data corresponding to the specific parameter, and to output a result of the determination.

13. The inference device according to claim 10, wherein the specific model has been trained by machine learning, wherein the machine learning includes supervised learning.

14. The inference device according to claim 10, wherein the specific model includes a neural network.

15. The inference device according to claim 10, wherein the circuitry is configured to acquire, as time passes, the operation data from the air conditioning system, which is used to convert the specific model into a trained model, wherein the at least one of the temperature of air passing through the second heat exchanger, the temperature and the pressure of the refrigerant, and the temperature outside the space where each of the at least one indoor unit is arranged, are associated with each other.

16. The inference device according to claim 10, further comprising a memory configured to store the specific model.

17. The inference device according to claim 10, wherein the circuitry is further configured to cluster and weight parameters in the operation data.

18. The inference device according to claim 10, wherein the circuitry is further configured to update a weight and bias of the specific model using back propagation with respect to an error between an output result of the specific model and ground truth data.

* * * * *